US009386389B2

(12) United States Patent
Noro

(10) Patent No.: US 9,386,389 B2
(45) Date of Patent: Jul. 5, 2016

(54) AUDIO SIGNAL PROCESSING DEVICE

(71) Applicant: YAMAHA CORPORATION, Hamamatsu-shi, Shizuoka-ken (JP)

(72) Inventor: Masao Noro, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/658,659

(22) Filed: Mar. 16, 2015

(65) Prior Publication Data

US 2015/0195667 A1 Jul. 9, 2015

Related U.S. Application Data

(63) Continuation of application No. 13/659,004, filed on Oct. 24, 2012, now Pat. No. 9,008,318.

(30) Foreign Application Priority Data

Oct. 26, 2011 (JP) ..... 2011-235211

(51) Int. Cl.
*H04S 3/00* (2006.01)
*H04R 5/04* (2006.01)

(52) U.S. Cl.
CPC *H04S 3/002* (2013.01); *H04R 5/04* (2013.01); *H04S 2400/03* (2013.01)

(58) Field of Classification Search
None
See application file for complete search history.

(56) References Cited

U.S. PATENT DOCUMENTS

| | | | |
|---|---|---|---|
| 4,910,778 | A | 3/1990 | Barton |
| 5,862,228 | A | 1/1999 | Davis |
| 6,507,657 | B1 | 1/2003 | Kamada |
| 2002/0154783 | A1 | 10/2002 | Fincham |
| 2003/0016837 | A1 | 1/2003 | Chen |
| 2011/0268299 | A1 | 11/2011 | Oda |

(Continued)

FOREIGN PATENT DOCUMENTS

| | | | |
|---|---|---|---|
| JP | H03266599 | A | 11/1991 |
| JP | 10322799 | A | 12/1998 |
| JP | 2004104296 | A | 4/2004 |

(Continued)

OTHER PUBLICATIONS

Japanese Office Action issued in Japanese counterpart application No. JP2014-020871, mailing date Oct. 21, 2014.

(Continued)

*Primary Examiner* — Paul Huber
(74) *Attorney, Agent, or Firm* — Rossi, Kimms & McDowell LLP

(57) ABSTRACT

An audio signal processing device receives a plurality of audio signals via a left channel (L) and a right channel (R) so as to produce a composite signal L+R and a difference signal L−R. The composite signal L+R is changed in phase with an all-pass filter, while the difference signal L−R is changed in phase and frequency characteristic with a band-pass filter (e.g. a center frequency of 1 kHz). The band-pass filter has a gently curved frequency characteristic achieving a broad passing band. Additionally, a phase difference of 90 degrees is maintained between the all-pass filter and the band-pass filter over the entire audio frequency range. The composite signal and the difference signal are adjusted in their levels and then mixed together to produce a monaural signal achieving an audio surround effect for widely propagating sound into the surrounding space without degrading sound quality.

19 Claims, 6 Drawing Sheets

(56) References Cited

U.S. PATENT DOCUMENTS

| | | | |
|---|---|---|---|
| 2011/0311061 | A1 | 12/2011 | Oshikiri |
| 2013/0108056 | A1 | 5/2013 | Noro |

FOREIGN PATENT DOCUMENTS

| | | | |
|---|---|---|---|
| JP | 2004521541 | A | 7/2004 |
| JP | 4526757 | B2 | 8/2010 |
| JP | 2013093772 | A | 5/2013 |
| WO | 02065815 | A2 | 8/2002 |
| WO | 2010076850 | A1 | 7/2010 |

OTHER PUBLICATIONS

Notice of Allowance issued in U.S. Appl. No. 13/659,004, mailed on Dec. 9, 2014.

Office Action issued in Japanese Appln. No. 2015-148209 mailed Apr. 26, 2016. English translation provided.

AUDIO SIGNAL PROCESSING DEVICE

BACKGROUND OF THE INVENTION

1. Field of the Invention

The present invention relates to an audio signal processing device which carries out various types of processing on audio signal, and in particular to an audio signal processing device which processes monaural signals input thereto.

The present application claims priority on Japanese Patent Application No. 2011-235211, the entire content of which is incorporated herein by reference.

2. Description of the Related Art

Audio signal processing devices for processing audio signals such as monaural signals have been conventionally known. For example, Patent Literature 1 discloses a surround reproduction circuit which produces a monaural surround signal widely propagating sound into the surrounding space with a monaural speaker. Specifically, the surround reproduction circuit receives a right-channel signal (R) and a left-channel signal (L) so as to produce a difference signal L−R and a composite signal L+R. The difference signal L−R is supplied to a low-pass filter, multiplied with a predetermined gain, and then added to the composite signal L+R, thus achieving a widely propagating effect of sound.

The surround reproduction circuit of Patent Literature 1 includes a low-pass filter, which in turn causes an acoustic deficiency in which the high-frequency range of a difference signal L−R may undergo phase variation while the low-frequency range may not undergo phase variation. Thus, frequency characteristics will be disintegrated when the difference signal L−R is added to the composite signal L+R. Additionally, a higher gain applied to the difference signal L−R may excessively enhance the low-frequency range of sound.

CITATION LIST

Patent Literature

Patent Literature 1: Japanese Patent No. 4526757

SUMMARY OF THE INVENTION

It is an object of the present invention to provide an audio signal processing device which is able to prevent a significant variation of frequency characteristics due to mixing of a difference signal and a composite signal derived from audio signals of different channels.

The present invention is directed to an audio signal processing device including an input part for inputting multichannel audio signals via a plurality of channels, a composite signal generator for generating a composite signal based on multichannel audio signals, a difference signal generator for generating a difference signal between multichannel audio signals, a phase-shift processor for changing the phase of a composite signal, a frequency processor for changing the frequency characteristic of a difference signal and for changing the phase of a difference signal, and an output part for mixing signals output from the phase-shift processor and the frequency processor, thus producing an output signal.

For example, the audio signal processing device receives a right-channel signal (R) and a left-channel signal (L) so as to produce a difference signal L−R and a composite signal L+R. The audio signal processing device changes the frequency characteristic and the phase of a difference signal L−R while changing the phase of a composite signal L+R depending on a phase variation of the difference signal L−R, thus controlling a phase difference between the difference signal and the composite signal. It is possible to prevent disintegration of frequency characteristics as long as the phase difference between the difference signal and the composite signal is maintained in a specific frequency range (e.g. a frequency range less than 10 kHz causing a significant impact on sound quality). In this frequency range, it is possible to prevent a certain band of sound from being excessively enhanced even when a high gain is applied to a difference signal.

In the above, it is not necessary to maintain the phase difference between a difference signal and a composite signal in a specific frequency range, but it is preferable to maintain the phase difference in the entire audio frequency range, thus achieving good sound quality.

It is possible to adopt a first-order band-pass filter to change the frequency variation and the phase of a difference signal. Herein, it is preferable that the center frequency of a band-pass filter be set to a certain frequency range (e.g. a frequency range from 300 Hz to 5 kHz) causing a significant impact on sound localization.

It is possible to adopt a first-order all-pass filter as the phase-shift processor. The all-pass filter exhibits a desired phase characteristic in which the phase thereof is gradually varied in a phase range from 0 degrees to −180 degrees. For this reason, it is preferable to set the phase characteristic of the band-pass filter in conformity with the phase characteristic (or the frequency characteristic) of the all-pass filter. For example, it is possible to set the center frequency of the band-pass filter at the frequency causing phase shift of 90 degrees. Additionally, it is possible to set the frequency characteristic of the band-pass filter (or the gain-frequency characteristic) such that the phase characteristic of the band-pass filter can substantially match the phase characteristic of the all-pass filter.

Moreover, it is possible to adopt a digital signal processor (DSP) as the phase-shift processor and the frequency processor, which are thus redesigned to perform digital signal processing. Alternatively, it is possible to adopt an analog circuit including an operational amplifier, a resistor, and a capacitor. Compared to digital signal processing using a DSP, an analog circuit is advantageous in that it can be designed with a very low cost.

As described above, the present invention is able to prevent a significant variation of a frequency characteristic even when a difference signal and a composite signal are combined together.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1:
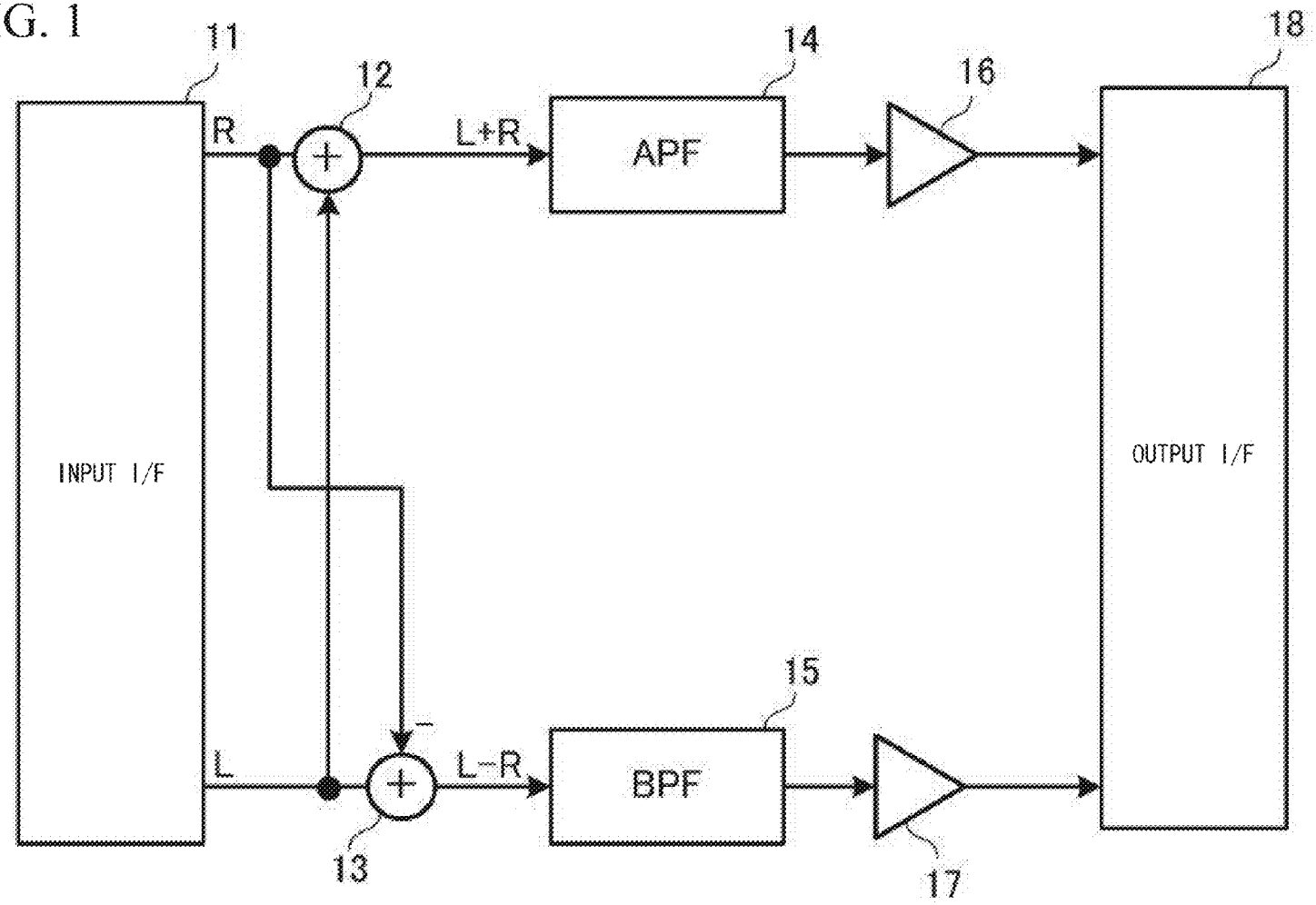
FIG. 1 is a block diagram of an audio signal processing device according to a preferred embodiment of the present invention.

FIG. 1 is a block diagram of an audio signal processing device according to a preferred embodiment of the present invention. The audio signal processing device is designed to receive multichannel audio signals via a plurality of channels, perform mixing-down on them, and thereby produce a monaural audio signal. In the following description, the audio signal processing device receives audio signals which are analog signals input thereto.

The audio signal processing device includes an input interface (I/F) 11, adders 12, 13, an all-pass filter (APF) 14, a band-pass filter (BPF) 15, level adjusters 16, 17, and an output interface (I/F) 18.

The input I/F 11 receives audio signals from another device (not shown) or a content reproduction part of the audio processing device (not shown). The following description will be given with respect to "analog" audio signals, but it is possible to receive digital audio signals by use of a digital-to-analog (D/A) converter additionally installed in the input I/F 11. In order to receive encoded data (e.g. digital data according to MP3), it is necessary to install a decoder in the input I/F 11. Audio signals include a right-channel signal (R) and a left-channel signal (L) which are supplied to the adders 12, 13.

The adder 12 adds a right-channel signal and a left-channel signal so as to produce a composite signal L+R. The adder 13 subtracts a right-channel signal from a left-channel signal so as to produce a difference signal L−R. In this connection, it is possible to a difference signal R−L subtracting a left-channel signal from a right-channel signal.

The difference signal L−R (or R−L) rejects common-mode components (i.e. components having the same phase) between a right-channel signal and a left-channel signal; hence, the difference signal mainly includes specific components (e.g. reverberant components) causing a significant impact on an audio surround effect. The audio signal processing device is designed to add the difference signal to the composite signal, thus achieving an audio surround effect widely propagating sound into the surrounding space with a single speaker implementing monaural reproduction based on the composite signal. Simply adding the difference signal and the composite signal may reject a right-channel component or a left-channel component. To remedy this drawback, the audio signal processing device implements a phase-shift processor and a frequency processor with the APF 14 and the BPF 15, thus achieving optimum signal processing in which adding the difference signal and the composite signal may not reject a right-channel component and a left-channel component so as to produce an output signal not undergoing a significant variation of frequency characteristics.

The APF 14 serving as a phase-shift processor is a first-order filter which changes the phase of an input signal by 90 degrees but maintains its original frequency characteristic (or its gain-frequency characteristic). The APF 14 receives a composite signal L+R from the adder 12. The BPF 15 serving as a frequency processor is a first-order filter which allows an input signal of a predetermined frequency band to be transmitted therethrough. The BPF 15 receives a difference signal L−R from the adder 13.

The frequency causing the phase shift of 90 degrees with the APF 14 is identical to the center frequency of the BPF 15. The audio signal processing device is designed based on predetermined circuit parameters in which the center frequency of the BPF 15 is set to 1 kHz because the APF 14 causes the phase shift of 90 degrees at 1 kHz. Basically, both the frequency causing the phase shift of 90 degrees with the APF 14 and the center frequency of the BPF 15 are selected from among specific frequencies, approximately ranging from 300 Hz to 5 kHz, causing a significant impact on sound localization. Actually, however, these frequencies can be appropriately determined in consideration of audio characteristics of a speaker and the property of an input audio signal (or the content of a sound source, not shown). The frequency characteristic (or the gain-frequency characteristic) of the BPF 15 can be determined based on the frequency characteristic (or the phase characteristic) of the APF 14. Details will be described later.

An output signal of the APF 14 (i.e. the composite signal L+R passing through the APF 14) is supplied to the level adjuster 16, whilst an output signal of the BPF 15 (i.e. the difference signal L−R passing through the BPF 15) is supplied to the level adjuster 17. The level adjusters 16, 17 adjust the levels of the composite signal L+R and the difference signal L−R so as to forward them to the output I/F 18.

It is possible to enhance an audio surround effect by increasing the gain of the level adjuster 17, whilst it is possible to enhance the common-mode component by increasing the gain of the level adjuster 16. When the sound source includes human voice, for example, it is necessary to enhance human voice by increasing the gain of the level adjuster 16. When the sound source produces background music (BGM), it is necessary to enhance an audio surround effect by decreasing the gain of the level adjuster 16. Alternatively, it is possible to provide audio setting suited to a listener's preference. In this connection, it is possible to fixedly set the gains of the level adjusters 16, 17, or it is possible to additionally install a user interface which allows users to arbitrarily adjust the gains of the level adjusters 16, 17.

The output I/F 18 mixes together the composite signal L+R and the difference signal L−R, the levels of which are adjusted by the level adjusters 16, 17, thus outputting a mixed signal. The mixed signal is amplified with a power amplifier (not shown) and then converted into audio sound with a speaker (not shown).

Figure 2A:
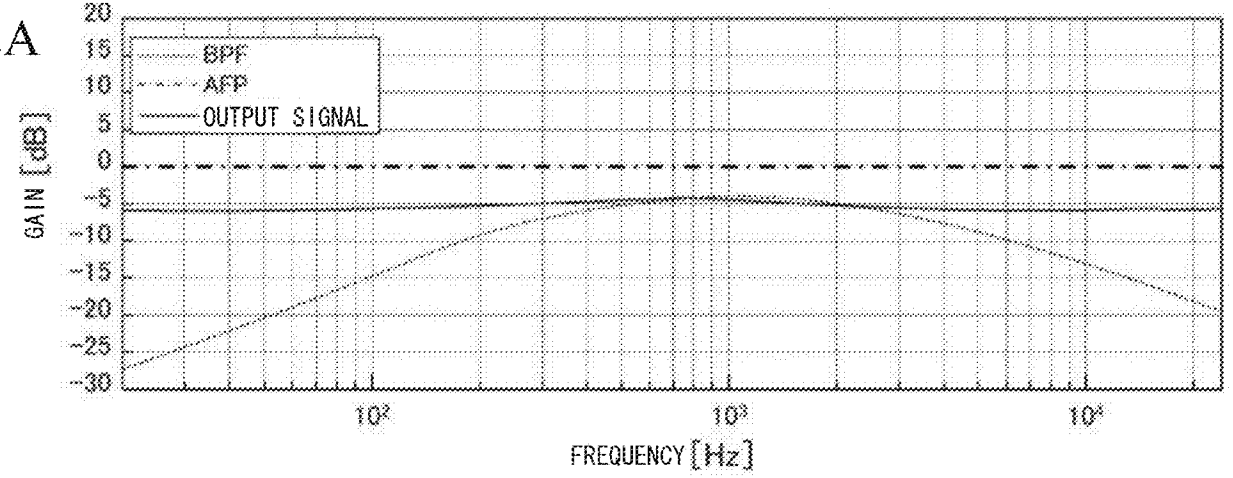
FIG. 2A is a graph showing the gain-frequency characteristic with respect to an all-pass filter (APF), a band-pass filter (BPF), and an output signal of the audio signal processing device.
Figure 2B:
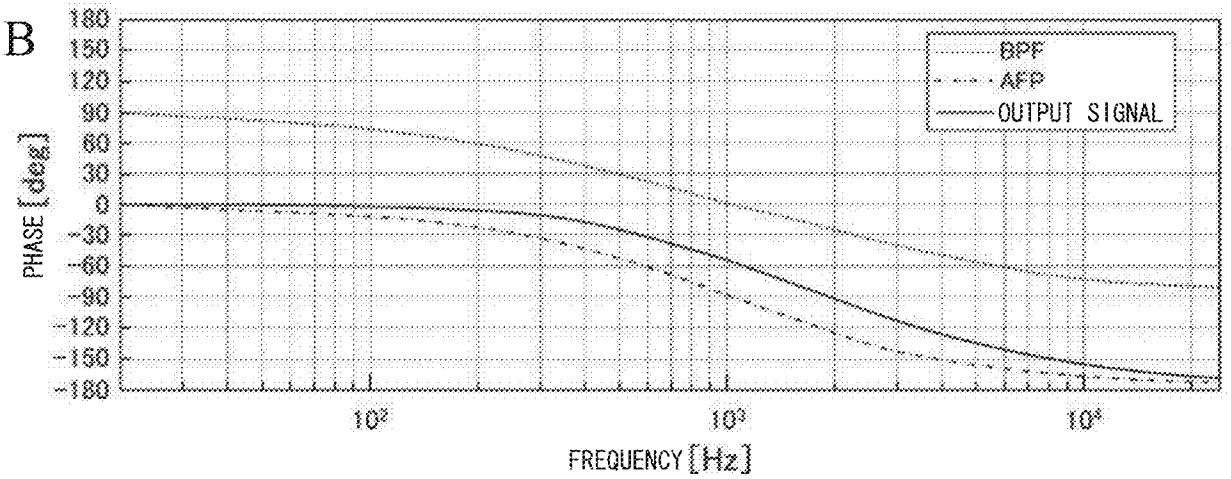
FIG. 2B is a graph showing the phase-frequency characteristic with respect to the APF, the BPF, and the output signal of the audio signal processing device.

Next, the frequency characteristic and the phase characteristic regarding the APF 14 and the BPF 15 will be described with reference to FIGS. 2A and 2B. FIG. 2A is a graph showing the frequency characteristic (i.e. the gain-frequency characteristic) with respect to the APF 14, the BPF 15, and the output signal of the output I/F 18. FIG. 2B is a graph showing the phase characteristic (i.e. the gain-frequency characteristic) with respect to the APF 14, the BPF 15, and the output signal of the output I/F 18.

The APF 14 exhibits the completely flat frequency characteristic (with a gain of 0 dB over all frequencies) as shown in FIG. 2A and a gently curved phase characteristic, the phase of which gradually varies from 0 degrees to −180 degrees over low frequencies to high frequencies. The circuit parameters of the APF 14 are determined such that the phase of the APF 14 will reach −90 degrees at a specific frequency of 1 kHz causing a significant impact on sound localization as shown in FIG. 2B.

The center frequency of the BPF 15 is set to 1 kHz as shown in FIG. 2A. But, no phase change occurs at the center frequency of the BPF 15 as shown in FIG. 2B. Thus, the phase difference between the composite signal L+R passing through the APF 14 and the difference signal L−R passing through the BPF 15 is set to 90 degrees at 1 kHz. FIG. 2A shows a peak gain of −3 dB with the BPF 15 which implements a gain characteristic (corresponding to the gain of the level adjuster 17) amplifying the output signal with a gain of −6 dB. Actually, however, the peak gain of the BPF 15 can be determined based on a desired gain applied to the output signal.

Additionally, the circuit parameters of the BPF 15 are determined such that the phase characteristic of the BPF 15 may resemble the phase characteristic of the APF 14. Specifically, the circuit parameters of the BPF 15 are determined according to the phase characteristic of the APF 14 such that the BPF 15 may exhibit a gently curved frequency characteristic, thus achieving a broad passing band in which a gain of about −3 dB is maintained in a certain frequency range of 300 Hz to 5 kHz.

As described above, the predetermined phase difference (e.g. 90 degrees) is maintained over the entire audio frequency range with the APF 14 and the BPF 15. FIG. 2A shows the flat frequency characteristic of the output signal indicating that the frequency characteristic will not be significantly disintegrated even when the composite signal L+R passing through the APF 14 is added to the difference signal L−R passing through the BPF 15. Thus, it is possible to prevent a certain band from being excessively enhanced even when a high gain is applied to the difference signal (or even when the gain of the difference signal is identical to the gain of the composite signal), thus achieving an optimum audio surround effect widely propagating sound into the surrounding space without degrading sound quality.

Both the APF 14 and the BPF 15 having the foregoing characteristics can be designed using an analog circuit (which may be configured of an operational amplifier, a resistor, and a capacitor) with a very low cost. The phase-shift processor and the frequency processor can be implemented according to digital signal processing using a DSP. Specifically, it is necessary to signal processing solely changing the phase of a composite signal and another signal processing appropriately changing the frequency characteristic and the phase of a difference signal depending on a phase variation of a composite signal.

The present embodiment determines the frequency characteristic of the BPF 15 such that a predetermined phase difference can be maintained between the APF 14 and the BPF 15 over the entire audio frequency range. Actually, however, it is unnecessary to maintain the predetermined phase difference over the entire audio frequency range. In particular, the present embodiment should aim to maintain the predetermined phase difference between the APF 14 and the BPF 15 in a certain frequency range (e.g. frequencies less than 10 kHz) causing a significant impact on sound quality.

The present embodiment implements audio reproduction of two channels, i.e. a left channel and a right channel, by use of a monaural speaker. It is possible to redesign the present embodiment such that the audio signal processing device can process audio signals via a rear-left channel (SL) and a rear-right channel (SR). That is, the audio signal processing device is redesigned to produce a composite signal SL+SR and a difference signal SL−SR. Herein, the composite signal SL+SR is subjected to phase-shift processing with the APF 14, whilst the difference signal SL−SR is subjected to phase-shift processing and frequency processing with the BPF 15. This audio signal processing device can be preferably applied to the situation where a single speaker is located in the rear of a listener (or a user) so as to reproduce audio signals via an SL channel and an SR channel.

Additionally, the audio signal processing device can be preferably applied to the situation where a single speaker is arranged to reproduce audio signals via a large number of channels.

The present embodiment of the audio signal processing device is not restrictive but illustrative; hence, it is possible to produce various types of audio signal processing device based on the basic configuration shown in FIG. 1.

(1) First Variation

Figure 3:
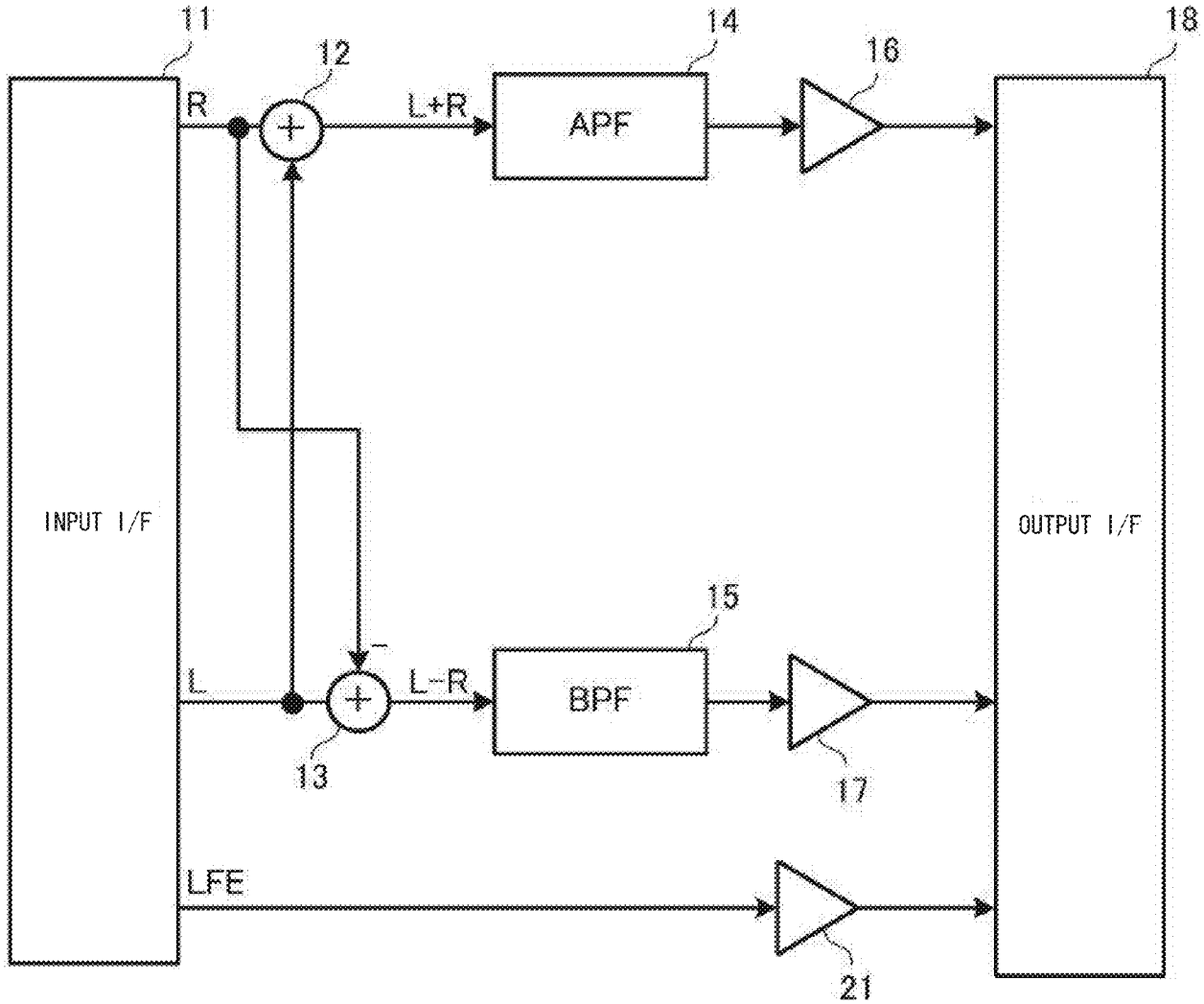
FIG. 3 is a block diagram of an audio signal processing device according to a first variation.

FIG. 3 is a block diagram of an audio signal processing device according to a first variation, wherein parts corresponding to those shown in FIG. 1 are specified using the same reference signs; hence, detailed descriptions thereof will be omitted here. The audio signal processing device of FIG. 3 implements 2.1 channel reproduction additionally including a low-frequency exclusive channel (LFE). The audio signal processing device additionally includes a level adjuster 21 for adjusting the level of an audio signal of an LFE channel (hereinafter, simply referred to as an LFE signal). An LFE signal is adjusted in level via the level adjuster 21 and then supplied to the output I/F 18.

The output I/F 18 mixes a composite signal L+R (whose level has been adjusted via the level adjuster 16), a difference signal L−R (whose level has been adjusted via the level adjuster 17), and an LFE signal (whose level has been adjusted via the level adjuster 21), thus outputting a mixed signal. Thus, the audio signal processing device is able to produce a monaural signal based on audio signals of 2.1 channels input thereto. That is, it is possible to achieve an audio surround effect for widely propagating sound into the surrounding space with a single speaker.

(2) Second Variation

Figure 4:
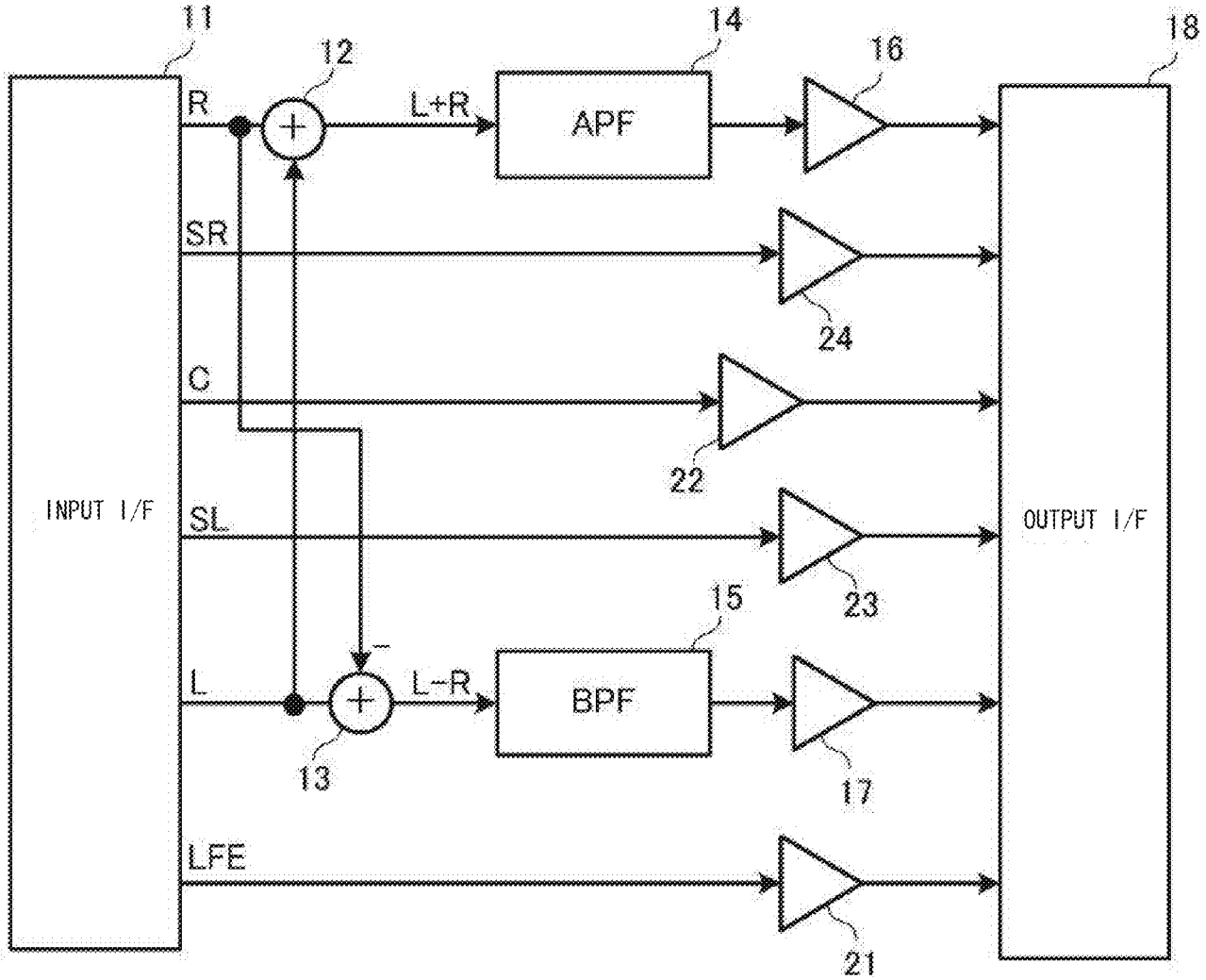
FIG. 4 is a block diagram of an audio signal processing device according to a second variation.

FIG. 4 is a block diagram of an audio signal processing device according to a second variation, wherein parts identical to those shown in FIG. 3 are specified by the same reference signs; hence, detailed descriptions thereof will be omitted. The audio signal processing device of FIG. 4 implements 5.1 channel reproduction additionally including a center channel (C), a rear-left channel (SL), and a rear-right channel (SR). The audio signal processing device additionally includes a level adjuster 22 for adjusting the level of an audio signal of a channel C (hereinafter, simply referred to as a C signal), a level adjuster for adjusting the level of an audio signal of an audio signal of a channel SL (hereinafter, simply referred to as an SL signal), and a level adjuster 24 for adjusting the level of a channel SR (hereinafter, simply referred to as an SR signal). These signals are supplied to the output I/F 18.

The output I/F 18 mixes a composite signal L+R (whose level has been adjusted via the level adjuster 16), a difference signal L−R (whose level has been adjusted via the level adjuster 17), an LFE signal (whose level has been adjusted via the level adjuster 21), a C signal (whose level has been adjusted via the level adjuster 22), an SL signal (whose level has been adjusted via the level adjuster 23), and an SR signal (whose level has been adjusted via the level adjuster 24), thus producing a mixed signal. Thus, the audio signal processing device is able to produce a monaural signal based on audio signals of 5.1 channels. That is, it is possible to achieve an audio surround effect for widely propagating sound into the surrounding space with a single speaker.

The audio signal processing device of FIG. 4 is designed to produce the composite signal L+R and the difference signal L−R by use of two signals L, R among 5.1 ch signals. This is because 5.1 ch music sources are normally produced based on a certain allocation of sound sources in which vocal or solo instrumental sound is allocated to the center channel (C) whilst accompaniment music or orchestra music is allocated to the right/left channels (L, R). The center channel signal C is monaural sound which can be maintained as it is. By simply adding the signals L, R, it is possible to perform monaural processing using most of music components. The rear channel signals SL, SR may substantially include reverberant components without any phase correlation with music components included in the signals C, L, and R; hence, adding the signals L, R may not cancel out original signal components. For this reason, it is possible to redesign the audio signal processing device such that the composite signal L+R and the difference signal L−R are produced using two-channel signals L, R among 5.1 ch signals, subjected to phase shifting and then added together to form a monaural signal.

(3) Third Variation

Figure 5:
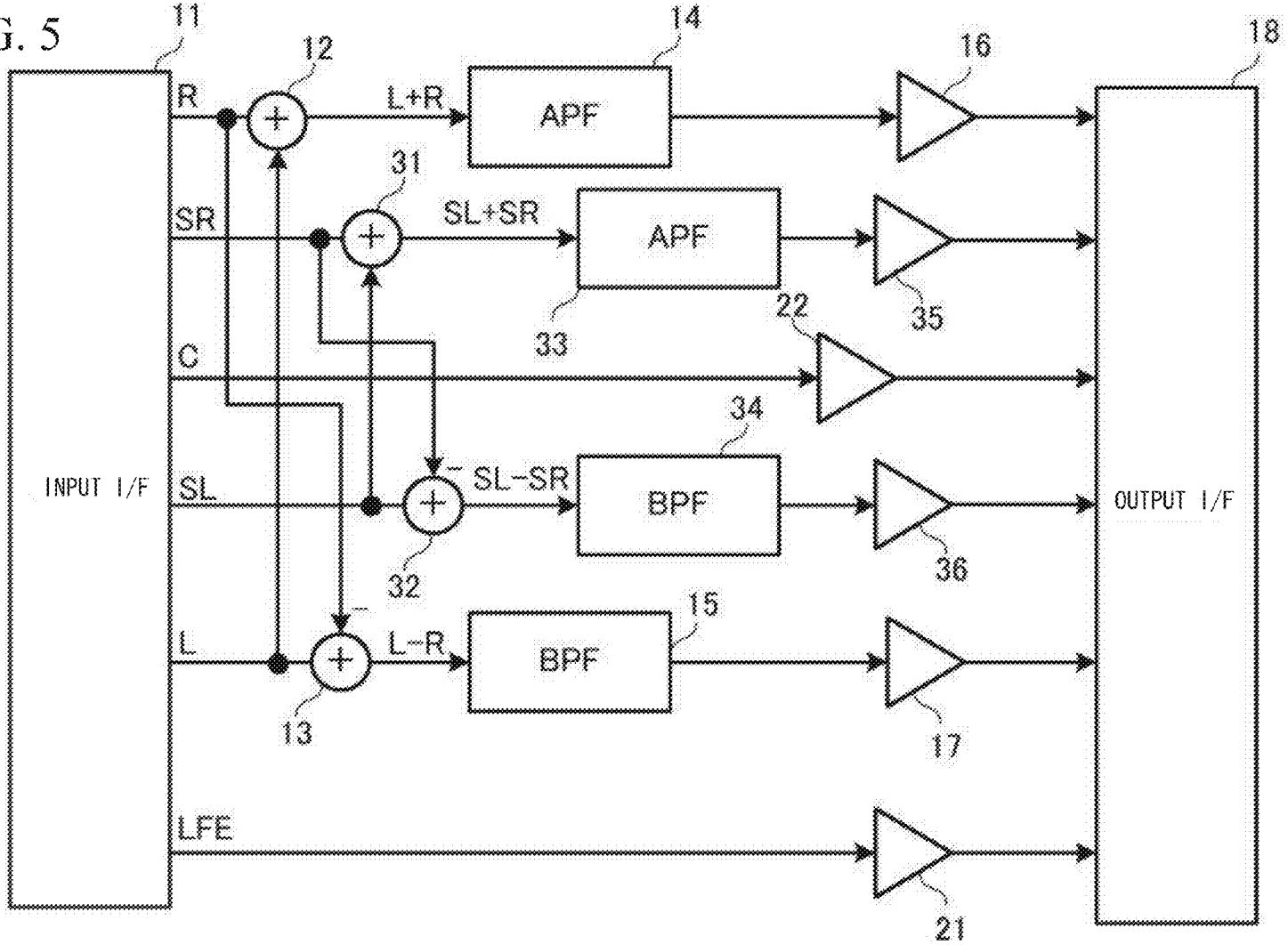
FIG. 5 is a block diagram of an audio signal processing device according to a third variation.

FIG. 5 is a block diagram of an audio signal processing device according to a third variation, wherein parts identical to those shown in FIG. 4 are specified by the same reference signs; hence, detailed descriptions thereof will be omitted. The audio signal processing device of FIG. 5 additionally includes adders 31, 32, an all-pass filter (APF) 33, a band-pass filter (BPF) 34, and level adjusters 35, 36. The adder 31 adds an SL signal and an SR signal together to produce a rear composite signal SL+SR. The adder 32 subtracts an SR signal from an SL signal to produce a rear difference signal SL−SR. The APF 33 receives the rear composite signal SL+SR from the adder 31, whilst the BPF 34 receives the rear difference signal SL−SR from the adder 32. The level adjuster 35 adjusts the level of the rear composite signal SL+SR passing through the APF 33, whilst the level adjuster 36 adjusts the level of the rear difference signal SL−SR passing through the BPF 34.

The APF 33 and the BPF 34 have substantially the same characteristics as the APF 14 and the BPF 15. That is, the APF 33 carries out phase shift of 90 degrees on the rear composite signal SL+SR at 1 kHz, whilst the BPF 34 maintains a phase difference of 90 degrees between the rear difference signal SL−SR and the rear composite signal SL+SR over the entire audio frequency range. The output I/F 18 receives these signals.

The output I/F 18 mixes a composite signal L+R (whose level has been adjusted via the level adjuster 16), a difference signal L−R (whose level has been adjusted via the level adjuster 17), an LFE signal (whose level has been adjusted via the level adjuster 21), a C signal (whose level has been adjusted via the level adjuster 22), a rear composite signal SL+SR (whose level has been adjusted via the level adjuster 35), and a rear difference signal SL−SR (whose level has been adjusted via the level adjuster 36), thus producing a mixed signal. The audio signal processing device is able to maintain a phase difference of 90 degrees between the rear composite signal SL+SR and the rear difference signal SL−SR over the entire audio frequency range. Thus, it is possible to prevent significant disintegration of frequency characteristics, and it is possible to further enhance an audio surround effect for widely propagating sound into the surrounding space without degrading sound quality.

In this connection, the audio signal processing devices according to the first to third variations are not necessarily designed using analog circuitry. The first to third variations can be designed using digital circuitry such as a DSP. Additionally, the audio signal processing devices shown in FIGS. 1, 3-5 are not necessarily designed using all-pass filters and band-pass filters, which are illustrative and not restrictive.

It is possible to redesign the audio signal processing device of FIG. 5 such that the APFs 14, 33 are replaced with a single APF (e.g. 14) performing phase processing with respect to the composite signal L+R and the rear composite signal SL+SR.

As a phase different applying means other than the APF, it is possible to use an active device using an operational amplifier or a passive device configured of L, C, R components.

Figure 6:
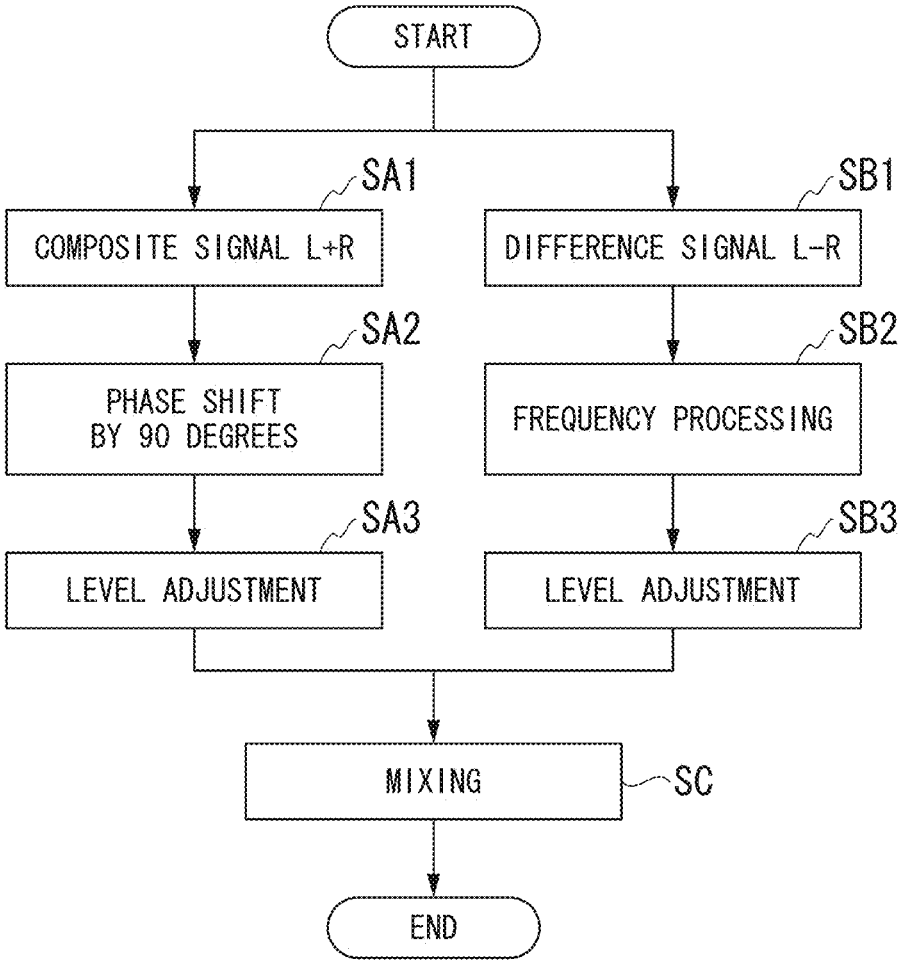
FIG. 6 is a flowchart illustrating an audio signal processing method based on the basic configuration shown in FIG. 1.

Next, an audio signal processing method based on the basic configuration shown in FIG. 1 will be described with reference to a flowchart of FIG. 6.

The audio signal processing method produces a mixed signal (serving as a monaural signal) based on a left-channel signal (L) and a right-channel signal (R) by way of the following steps.

In step SA1, an audio signal of a left channel and an audio signal of a right channel are added together so as to produce a composite signal L+R.

In step SA2, the composite signal L+R is subjected to phase shift by 90 degrees.

In step SA3, the level of the composite signal L+R is adjusted to a desired level.

In step SB1, an audio signal of a right channel is subtracted from an audio signal of a left channel so as to produce a difference signal L−R.

In step SB2, the difference signal L−R is subjected to frequency processing such that a phase difference of 90 degrees is maintained between the difference signal L−R and the composite signal L+R over the entire audio frequency range.

In step SB3, the level of the difference signal L−R is adjusted to a desired level.

In step SC, the composite signal L+R and the difference signal L−R are mixed together so as to produce a mixed signal serving as a monaural signal.

In the above, the steps SA1 to SA3 regarding the composite signal L+R can be concurrently executed with the steps SB1 to SB3 regarding the difference signal L−R. Alternatively, it is possible to additionally implement another step, prior to step SC, which makes a decision as to whether or not the composite signal L+R and the difference signal L−R are prepared through steps SA1-SA3 and steps SB1-SB3. When these signals are not concurrently produced (i.e. a decision result is "NO"), it is possible to exit the flow. Alternatively, when one of these signals is solely prepared, it is possible to discard the prepared signal and then repeat the flow again. The flowchart of FIG. 6 is created based on the configuration of FIG. 1, but it is possible to create other flowcharts based on the configurations shown in FIGS. 3 to 5. Additionally, it is possible to modify the step SA2 to perform all-pass filtering instead of phase shift, and it is possible to modify the step SB2 to perform band-pass filtering instead of frequency processing.

Lastly, the present invention is not necessarily limited to the foregoing embodiment and variations, which can be further modified in various ways within the scope of the invention as defined in the appended claims.

What is claimed is:

1. An audio signal processing device comprising:

an input interface configured to input audio signals of a plurality of channels;

a first signal generating device configured to mix the audio signals of the plurality of channels and generate a main signal;

a second signal generating device configured to mix the audio signals of the plurality of channels and generate a surround signal including surround components;

a phase-shift processor configured to change a frequency characteristic regarding a phase of the main signal;

a frequency processor configured to change a frequency characteristic regarding a gain of the surround signal; and an output interface configured to mix output signals of the phase-shift processor and the frequency processor and output a monaural signal, wherein the frequency processor changes a frequency characteristic regarding a gain while indicating a frequency characteristic regarding a phase corresponding to a frequency characteristic regarding a phase of the phase-shift processor.

2. The audio signal processing device according to claim 1, wherein the phase-shift processor changes the phase of the main signal to maintain a predetermined phase difference between the main signal and the surround signal over an entire audio frequency range.

3. The audio signal processing device according to claim 1, wherein the frequency processor is a band-pass filter.

4. The audio signal processing device according to claim 3, wherein a center frequency of the band-pass filter is set to a frequency causing a significant impact on sound localization.

5. The audio signal processing device according to claim 3, wherein the phase-shift processor is an all-pass filter that maintains a predetermined phase difference between the main signal and the surround signal over an entire audio frequency range.

6. The audio signal processing device according to claim 4, wherein the phase-shift processor is an all-pass filter that maintains a predetermined phase difference between the main signal and the surround signal over an entire audio frequency range.

7. The audio signal processing device according to claim 4, wherein the band-pass filter has a broad passing band ranging from 300 Hz to 5 kHz.

8. The audio signal processing device according to claim 5, wherein:

the band-pass filter has a broad passing band ranging from 300 Hz to 5 kHz, and the predetermined phase difference is set to 90 degrees.

9. The audio signal processing device according to claim 6, wherein:

the band-pass filter has a broad passing band ranging from 300 Hz to 5 kHz, and;

the predetermined phase difference is set to 90 degrees.

10. The audio signal processing device according to claim 1, wherein:

the first signal generating device comprises a first adder that obtains a composite signal of the audio signals of the plurality of channels to generate the main signal, and the second signal generating device comprises a second adder that obtains a difference signal from the audio signals of the plurality of channels to generate the surround signal.

11. An audio signal processing method comprising:

an input step of inputting audio signals on a plurality of channels via an audio interface;

a first signal generating step of mixing the audio signals of the plurality of channels and generating a main signal;

a second signal generating step of mixing the audio signals of the plurality of channels and generating a surround signal including surround components;

a phase shifting step of changing frequency characteristic regarding a phase of the main signal with a phase-shift processor;

a frequency changing step of changing a frequency characteristic regarding a gain of the surround signal with a frequency processor; and an output step of mixing output signals from the phase-shift processor and the frequency processor and outputting a monaural signal, wherein the frequency processor changes a frequency characteristic regarding a gain while indicating a frequency characteristic regarding a phase corresponding to a frequency characteristic regarding a phase of the phase-shift processor.

12. The audio signal processing method according to claim 11, wherein the phase shifting step changes the phase of the main signal to maintain a predetermined phase difference between the main signal and the surround signal over an entire audio frequency range.

13. The audio signal processing method according to claim 12, wherein the predetermined phase difference is set to 90 degrees.

14. The audio signal processing method according to claim 11, wherein the frequency characteristic of the surround signal covers a frequency range from 300 Hz to 5 kHz.

15. An audio signal processing device comprising:

an input interface configured to receiving a plurality of audio signals of 5.1 channels;

a first signal generating device configured to mix a left-channel signal and a right-channel signal among the plurality of audio signals of 5.1 channels and generate a main signal;

a second signal generating device configured to mix the left-channel signal and the right-channel signal and generate a surround signal;

a first phase-shift processor configured to change a frequency characteristic regarding a phase of the main signal;

a first frequency processor configured to change a frequency characteristic regarding a gain of the surround signal; and an output interface configured to mix output signals of the first phase-shift processor and the frequency processor and output a monaural signal, wherein the frequency processor changes a frequency characteristic regarding a gain while indicating a frequency characteristic regarding a phase corresponding to a frequency characteristic regarding a phase of the first phase-shift processor.

16. The audio signal processing device according to claim 15, wherein:

the first signal generating device comprises a first adder that obtains a composite signal of the left-channel signal and the right-channels signal to generate the main signal, and the second signal generating device comprises a second adder that obtains a difference signal between the left-channel signal and the right-channel signal to generate the surround signal.

17. The audio signal processing device according to claim 15, further comprising:

a third signal generating device configured to generate a secondary main signal using a rear left-channel signal and a rear right-channel signal among the plurality of signals of 5.1 channels;

a fourth signal generating device generates a secondary surround signal using the rear left-channel signal and the rear right-channel signal;

a second phase processor configured to change a frequency characteristic regarding a phase of the secondary main signal; and a second frequency processor configured to change a frequency characteristic regarding a gain of the secondary surround signal.

18. The audio signal processing device according to claim 17, wherein:

the first signal generating device comprises a first adder that obtains a composite signal of the left-channel signal and the right-channels signal to generate the main signal, and the second signal generating device comprises a second adder that obtains a difference signal between the left-channel signal and the right-channel signal to generate the surround signal.

19. The audio signal processing device according to claim 18, wherein:

the third signal generating device comprises a third adder that obtains a composite signal of the rear left-channel signal and the rear right-channels signal to generate the secondary main signal, and the fourth signal generating device comprises a fourth adder that obtains a difference signal between the rear left-channel signal and the rear right-channel signal to generate the secondary surround signal.

* * * * *